US005417292A

United States Patent [19]

Polakoff

[11] Patent Number: 5,417,292

[45] Date of Patent: May 23, 1995

[54] LARGE DIAMETER ROCK DRILL

[76] Inventor: Paul Polakoff, 17651 Wells Rd., N. Fort Myers, Fla. 33917

[21] Appl. No.: 156,285

[22] Filed: Nov. 22, 1993

[51] Int. Cl.[6] ..... E21B 10/28

[52] U.S. Cl. ..... 175/335; 175/391; 299/90

[58] Field of Search ..... 175/388, 391, 392, 335, 175/385, 397; 299/90, 89; 405/138

[56] References Cited

U.S. PATENT DOCUMENTS

| | | | |
|---|---|---|---|
| 3,821,993 | 7/1974 | Kniff et al. | 175/391 X |
| 4,448,269 | 5/1984 | Ishikawa et al. | 299/90 X |
| 5,308,150 | 5/1994 | Whitehouse | 299/90 X |

OTHER PUBLICATIONS

Redrill, Inc.; *Catalog of Drilling Tools;* Texoma Drilling Tools; Cover Page and pp. 4, 5 and 6, Jul. 1991.

*Primary Examiner*—William P. Neuder
*Attorney, Agent, or Firm*—Conley, Rose & Tayon

[57] ABSTRACT

A large diameter rock drill includes a tubular body and a central shaft longitudinally axially disposed with respect to the body. The shaft extends longitudinally axially above the top edge of the body and is attached to a drive means. A plurality of angularly spaced apart vertical plates are attached to the inside wall of the body and the shaft. Each of the plates has a lower edge which tapers downwardly and inwardly from the inside wall of the body toward the longitudinal axis of the drill near its lower end. The plates' lower edges taper downwardly and inwardly and have an array of closely packed pockets mounted thereon, each pocket receiving a drill tooth. The radially outermost pockets are affixed to vertically extending, outwardly projecting ribs on the body. The teeth face downwardly and outwardly, and are angled in a clockwise or counterclockwise direction. The teeth in adjacent arrays are offset from one another by an amount which results in substantially each tooth cutting around a unique circular path as the rock drill is rotated. A plurality of teeth are mounted on the lower circumferential outer periphery of the body, pointing downwardly and outwardly and angled in either a clockwise or counterclockwise direction. A pilot drill is mounted on the lower end of the drill. An expander attachment, having arrays of teeth which complement those on the basic unit and circumferentially disposed body teeth, may be secured around the basic rock drill unit in order to enlarge the effective drilling diameter of the drill.

17 Claims, 8 Drawing Sheets

FIG. 1
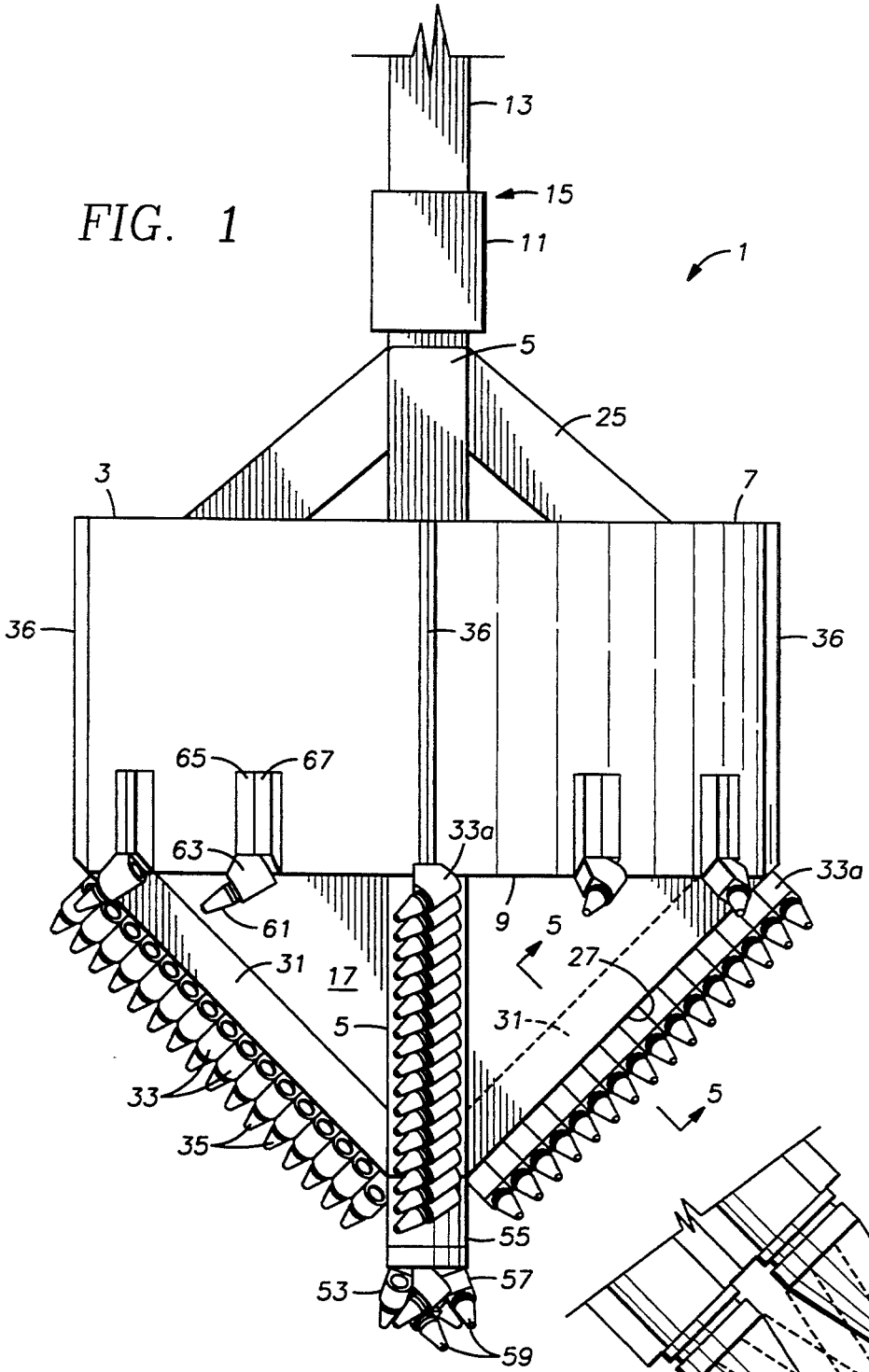
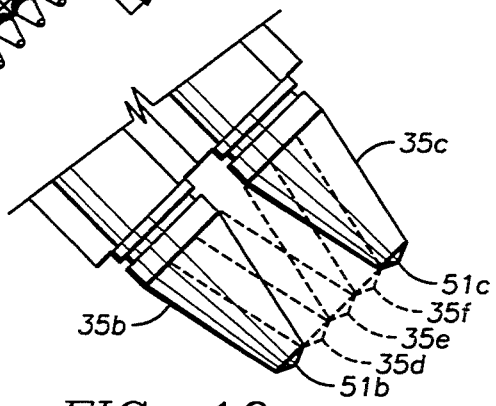
FIG. 10

FIG. 7
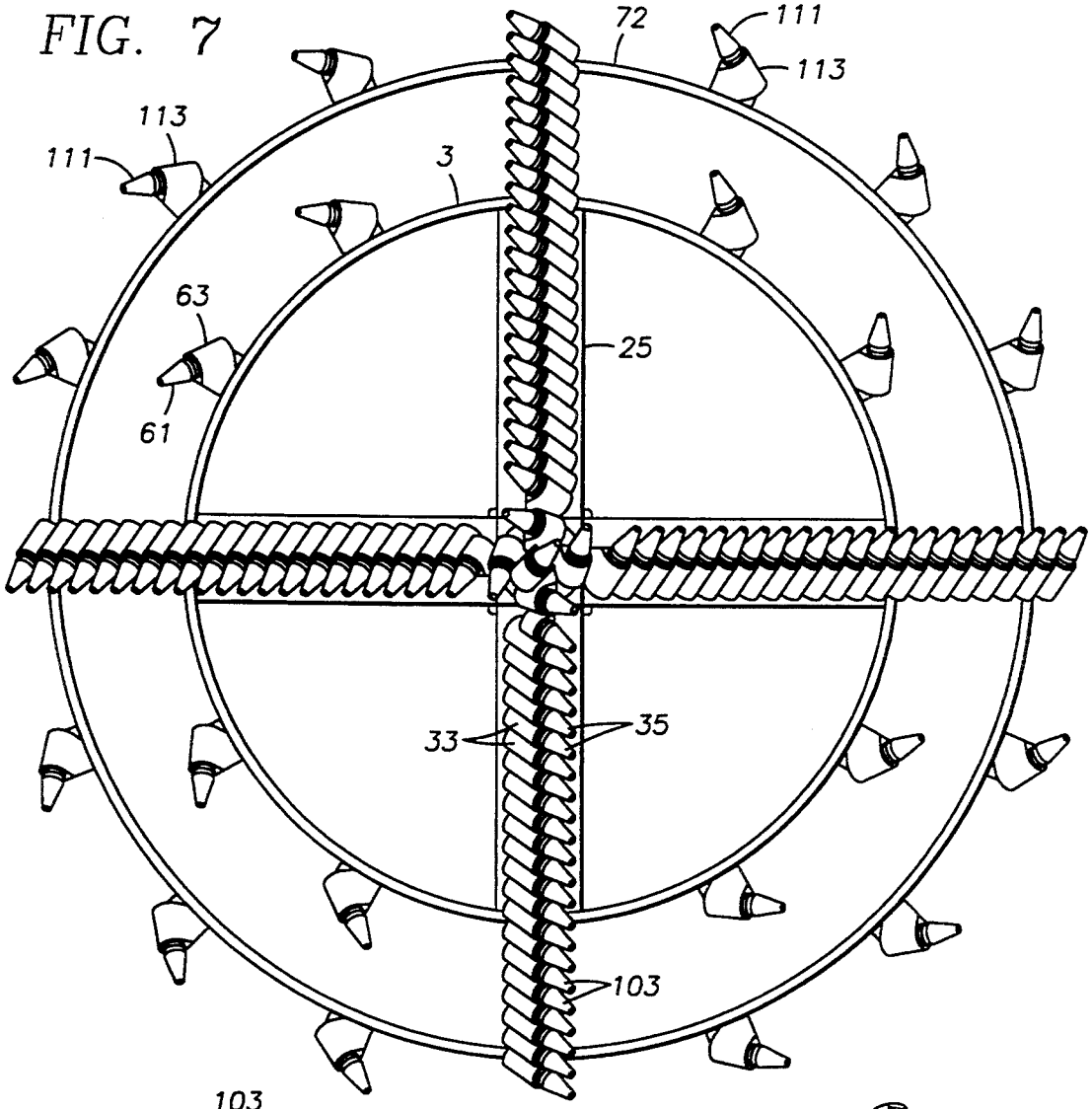
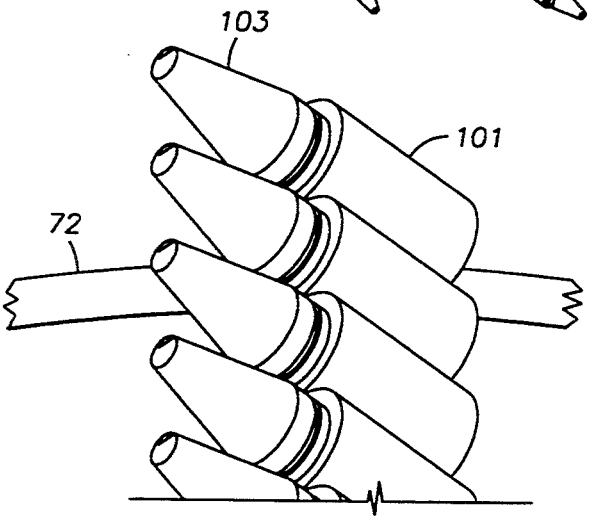
FIG. 8
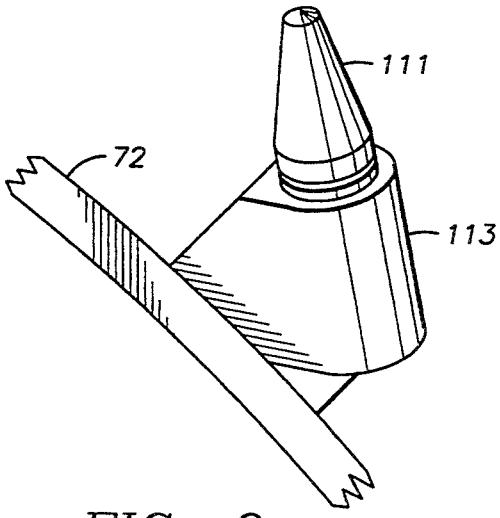
FIG. 9

LARGE DIAMETER ROCK DRILL

BACKGROUND OF THE INVENTION

The present invention relates to the field of borehole drilling, and more particularly to that of drilling relatively large diameter, substantially vertical boreholes. More particularly still, the present invention relates to the drilling of boreholes used to support street lighting, power poles, stadium lighting, or similar structures, or for constructing caissons or the like, such as those used to hold down a stadium roof or the like.

In order to provide adequate support for light poles, power poles, or the like, or to construct caissons such as those used to anchor the roof of a stadium or other structure, relatively large diameter boreholes must be drilled into the earth. Such boreholes typically can be from about 24 inches to about 72 inches in diameter. When drilled to the proper depth for the particular application, the pole or other structure is placed in the borehole, and the hole is backfilled with rock, soil or other material, or cemented in, to secure the pole or the like properly in the borehole, or to construct the caisson.

In the past, drilling of such large diameter boreholes has been relatively slow and inefficient, requiring rigs having relatively large torque and horsepower capabilities. One type of bit used in the past for drilling of this kind is the core barrel bit, which essentially is a piece of pipe with teeth disposed around its circumferential periphery. With this type of bit, as it rotates the teeth cut a circle around a core, which initially remains substantially intact within the bit. After the bit has traveled an incremental distance downhole, which may be about the same as the axial height of the bit, the core disposed inside the bit must be broken off from the earth or rock below before it can be removed from the hole. Sometimes the operators experience difficulty in breaking off the core; often special wedges or the like must be employed for this purpose. Breaking off the cores also tends to put undue stress on the drilling rig, as well as on the bits and on the bolts or like fasteners which secure the bits to the rig. Such stress can result in damage to the bits or the drilling rig, and can even lead to loss of the bits downhole.

Another type of bit used in the past for drilling relatively large diameter boreholes is the rock auger, which is referred to in the art as a righted bit. The term "flighted" means that the bit has a plurality of axially spaced apart surfaces or levels which may engage the borehole. The flights of the rock auger are thus the turns of the auger screw, which in cross section appear to be stacked, spaced apart, generally horizontal surfaces. Some of the rock augers used in the past have included a plurality of teeth welded in two opposed rows below their lower faces and extending to their edges. The teeth used in these prior art rock augers have typically been spaced at intervals of about 5 inches. It is believed that these two rows of teeth found in typical prior art rock augers grind, rather than cut or fracture, the rock during drilling. Grinding the rock rather than cutting or fracturing it is a relatively slow drilling process. This is a significant disadvantage for the rock auger-type bits. Another disadvantage results from the rather large (about 5 inches) spacing between the teeth of these prior art bits. The large spacing between teeth permits the rock at the borehole bottom to engage and wear both the tooth pockets and the bottom of the flighting of the bit. In addition, the outer peripheral edges of the flights of the auger tend to engage and bind or stick against the borehole walls, thus creating high torque on, and sometimes breaking, the drilling rigs or components thereof. Moreover, flighted bits such as the rock auger tend to walk on top of the rock and shift in the hole. Furthermore, sometimes it is difficult to lift a flighted bit out of the hole after accumulating a large volume of loose material atop the bit. The loose material rests on, and weighs down on, the upper surfaces of the flights, and when the bit is lifted up, so is all the loose material sitting on top of the bit. Lifting the loose material sitting on top of the bit requires additional horsepower from the rig, and places undue stress on the rig and on the bits. Moreover, when only 2 drilling tooth-edges are used, such as in the typical rock auger referred to above, and when several hard earth formations are interspersed with several soft ones, the 2 edges tend to ride up and down on the formations and subject the drilling rig to excessive shaking. This also varies the torque required from the rig, say from 30,000 foot-pounds down to 5,000 foot-pounds, and then back to 30,000 foot-pounds, and then back to 5,000 foot-pounds, etc. Besides unduly shaking the rig, this cycling of torque has the potential of severely damaging or breaking the drive shafts or other components of the rig.

SUMMARY OF THE INVENTION

The present invention overcomes the problems and drawbacks discussed above with conventional and prior art large diameter rock drills, by providing a novel and unique rock drill which drills large diameter boreholes taster, more efficiently, with lower power requirements, and with less wear and tear on the drilling rig and on the rock drill, than experienced with prior art drills. The present invention also drills smoother, with less shaking and vibration than prior art rock drills; with reduced tendency to become tilted or can ted in the borehole and greater tendency to stay centered in the borehole; and with greater accuracy, including a reduced tendency to walk in the borehole. The present invention accomplishes these while providing a strong, durable, relatively simple and easy to make and use rock drill which has the potential of greatly reducing the cost of drilling a large diameter borehole such as contemplated herein.

According to one embodiment of the present invention, the large diameter rock drill includes a generally circular cylindrical, hollow or tubular metal body and a central metal shaft coaxially disposed within the body, and extending longitudinally axially of the body above its top edge and below its bottom edge. The shaft is adapted for attachment to a drilling rig or other drive means for rotating the rock drill. A plurality of substantially vertically disposed plates are attached between the inside wall surface of the body and the exterior surface of the shaft. A plurality of reinforcing struts are affixed between the inside wall of the body and the outside surface of the shaft in angular alignment with one of the plates.

The lower edges of the plates each taper downwardly and inwardly from the inside wall of the body to the outside surface of the shaft near its lower end. Each plate is provided with a lower reinforcing member mounted on the plate adjacent to and running along its lower edge. The lower edges of the plates and attached reinforcing members have a plurality of tooth pockets mounted thereon, each pocket receiving a drill tooth, the plurality of drill teeth on each plate forming a substantially linear array. The pockets are closely packed together and attached to one another as well as to the plates and reinforcing members. The radially outermost pocket of each array is affixed to one of a plurality of vertically extending, radially outwardly projecting ribs disposed on the body. In a preferred embodiment, there are four such ribs spaced apart at 90-degree intervals and in angular register with the plates.

All of the pockets and teeth disposed on the plates and ribs face generally downwardly and outwardly, and are angled with respect to both the plates and the body toward the same general direction, i.e., clockwise or counterclockwise, depending on the intended direction of rotation of the rock drill. A pilot drill is mounted on the lower end of the shaft, and includes a plurality of pilot teeth which are similar to the teeth disposed on the plates. The pilot teeth also point generally downwardly and outwardly, and are arranged in a circular-type pattern such that they point in the same general direction, i.e., clockwise or counterclockwise, as the teeth on the plates.

The body also includes a plurality of drill teeth mounted on the lower circumferential outer periphery of the body, between the vertically extending ribs. The pockets in which the body teeth are disposed are mounted on pairs of vertically extending, radially outwardly projecting supports affixed to the body. The body teeth also point generally downwardly and outwardly, and are angled with respect to the body in either a clockwise or counterclockwise direction, like the arrays of teeth on the plates.

In order to maximize the number of teeth engaging the earth and rock during drilling, the teeth in adjacent arrays are offset from one another by an amount which results in substantially each tooth cutting around a unique circular path as the rock drill is rotated. In a preferred embodiment, a separate tooth located on one of the plates engages the earth about every one-half inch from the radially innermost tooth to the radially outermost tooth during drilling.

In the event that a larger hole is desired, the present invention also includes a drill expander attachment which may be attached to the basic rock drill unit in order to enlarge the effective drilling diameter of the invention. The drill expander attachment includes a generally circular cylindrical, hollow or tubular metal body of greater diameter than the body of the basic unit referred to above. The axial height of the expander body is less than that of the basic body, in order to permit the teeth of the basic body to extend below the expander body when the two bodies are assembled. In the assembled configuration, the upper edges of the two bodies are preferably flush with one another.

The expander body includes a plurality of radially projecting, circumferentially spaced apart, substantially vertically disposed spacer members welded or otherwise affixed to the ID wall of the expander body. The spacer members are preferably equi-angularly spaced apart around the ID of the expander body so as to be substantially in angular or radial register with the plates disposed on the basic body. Two L-shaped flanges are affixed to the opposite sides of each of the spacers along their radially inner edges. One leg of each flange is adapted to be attached to the OD wall of the basic body, with the ribs disposed on the basic body being housed in the space between the flanges.

The spacer members and flanges extend below the bottom edge of the expander body, and their lower faces or edges are tapered at substantially the same angle as the lower edges of the plates of the basic body. A reinforcing member may be affixed to one or both sides of the lower portion of each of the spacer members.

A plurality of pockets are mounted on the lower faces or edges of the spacers, flanges, and reinforcing members for receiving a like plurality of drill teeth which are oriented in substantially the same angular positions and directions with respect to the expander body as are the pockets and teeth of the basic body with respect thereto. When the two bodies are assembled, the radially innermost (and axially lowermost) pocket of each array on the expander body is disposed immediately adjacent to the radially outermost (and axially uppermost) pocket of the corresponding array on the basic body. The teeth on the expander body are offset in the same fashion as the teeth on the basic body. When the two bodies are assembled, the arrays of teeth on the expander body are essentially continuations of the arrays of teeth on the basic body.

The radially outermost pocket of each array on the expander body is affixed to one of a plurality of vertically extending, radially outwardly projecting ribs mounted on the outside wall of the expander body, in register with the spacers. There may be additional ribs, preferably equi-angularly spaced about the expander body. Between each pair of adjacent ribs, pairs of vertically extending, radially outwardly projecting supports are welded to one another and to the outside wall of the expander body.

The expander body also includes a plurality of body teeth mounted on its lower circumferential outer periphery, between the ribs which are in register with the spacers. The body teeth on the expander body are like those on the basic body, and are oriented in the same way.

When the two bodies are assembled, a larger borehole may be drilled than is possible with the basic unit. This expendability feature results in lower required inventory of complete drill units, because the same basic drill unit can be used as the central portion of virtually any sized add-on or expander unit.

According to an alternative embodiment of the present invention, the large diameter rock drill includes an annular drill ring body of generally circular cylindrical, hollow or tubular configuration within which are disposed a plurality of substantially vertically disposed plates. The plates extend both above and below the annular drill ring body, and are attached to its inside wall surface. The plates are affixed to one another along the central longitudinal axis of the rock drill of the present invention from the midportion to the lower end portion thereof. At the upper end portion of the rock drill of the present invention, the plates are affixed to a central, coaxially disposed shaft, which extends longitudinally axially above the topmost edges of the plates. The shaft is adapted for attachment to a drilling rig or other drive means for rotating the rock drill. An annular reinforcing ring surrounds and is affixed to the radially outermost edges of the plates above the annular drill ring body. The reinforcing ring also surrounds the lower end portion of the shaft.

The lower edges of the plates each taper downwardly and inwardly from the inside wall of the annular drill ring body toward the central longitudinal axis of the rock drill. Each plate is provided with a lower reinforcing member mounted on the plate adjacent to and running along its lower edge. The lower edges of the plates and attached reinforcing members have a plurality of tooth pockets mounted thereon, each pocket receiving a drill tooth, the plurality of drill teeth on each plate forming a substantially linear array in substantially the same fashion as the arrays of the first embodiment described above. As in the first embodiment, in this alternative embodiment the pockets are closely packed together and attached to one another as well as to the plates and reinforcing members. In this alternative embodiment, as in the first, the radially outermost pocket of each array is affixed to one of a plurality of vertically extending, radially outwardly projecting ribs disposed on the annular drill ring body. Preferably there are four such ribs spaced apart at 90-degree intervals and in angular register with the plates.

All of the pockets and teeth disposed on the plates and ribs in this alternative embodiment face or are "aimed," and angled, in the same general manner as those in the first embodiment. A pilot drill like that described above for the first embodiment is longitudinally axially mounted on the rock drill at its lower end, to the lower edge of the plates.

The annular drill ring body also includes a plurality of drill teeth mounted on its lower circumferential outer periphery between the vertically extending ribs, like the body teeth in the first embodiment. These teeth are disposed in pockets mounted on pairs of vertically extending, radially outwardly projecting supports affixed to the annular drill ring body, again like the supports in the first embodiment described above. Such body teeth are aimed and angled in like manner as the body teeth in the first embodiment.

The teeth in adjacent arrays of this alternative embodiment are offset from one another in like manner as those in the first embodiment.

The rock drill of the alternative embodiment may also be used with an expander ring to increase the size of the borehole to be drilled.

These and other objects and advantages of the invention will become apparent from the following description of the preferred embodiment when read in conjunction with reference to the following drawings, wherein:

BRIEF DESCRIPTION OF THE DRAWINGS

FIG. 1 is an elevational view of one embodiment of the basic rock drill unit of the present invention.

FIG. 7 is a bottom plan view of the combined apparatus of the embodiments of the present invention shown in FIGS. 2 and 3.

FIG. 8 is an enlarged fragmentary pictorial view of a portion of one of the arrays of drill teeth disposed on the embodiment of the expander attachment of the present invention referred to above.

FIG. 9 is an enlarged fragmentary pictorial view of one of the body teeth mounted on the circumferential periphery of the embodiment of the expander attachment body of the present invention referred to above.

FIG. 10 is a schematic illustration of the spacing of drill teeth in the linear arrays of the rock drill of the present invention.

DESCRIPTION OF THE PREFERRED EMBODIMENTS

Figure 2:
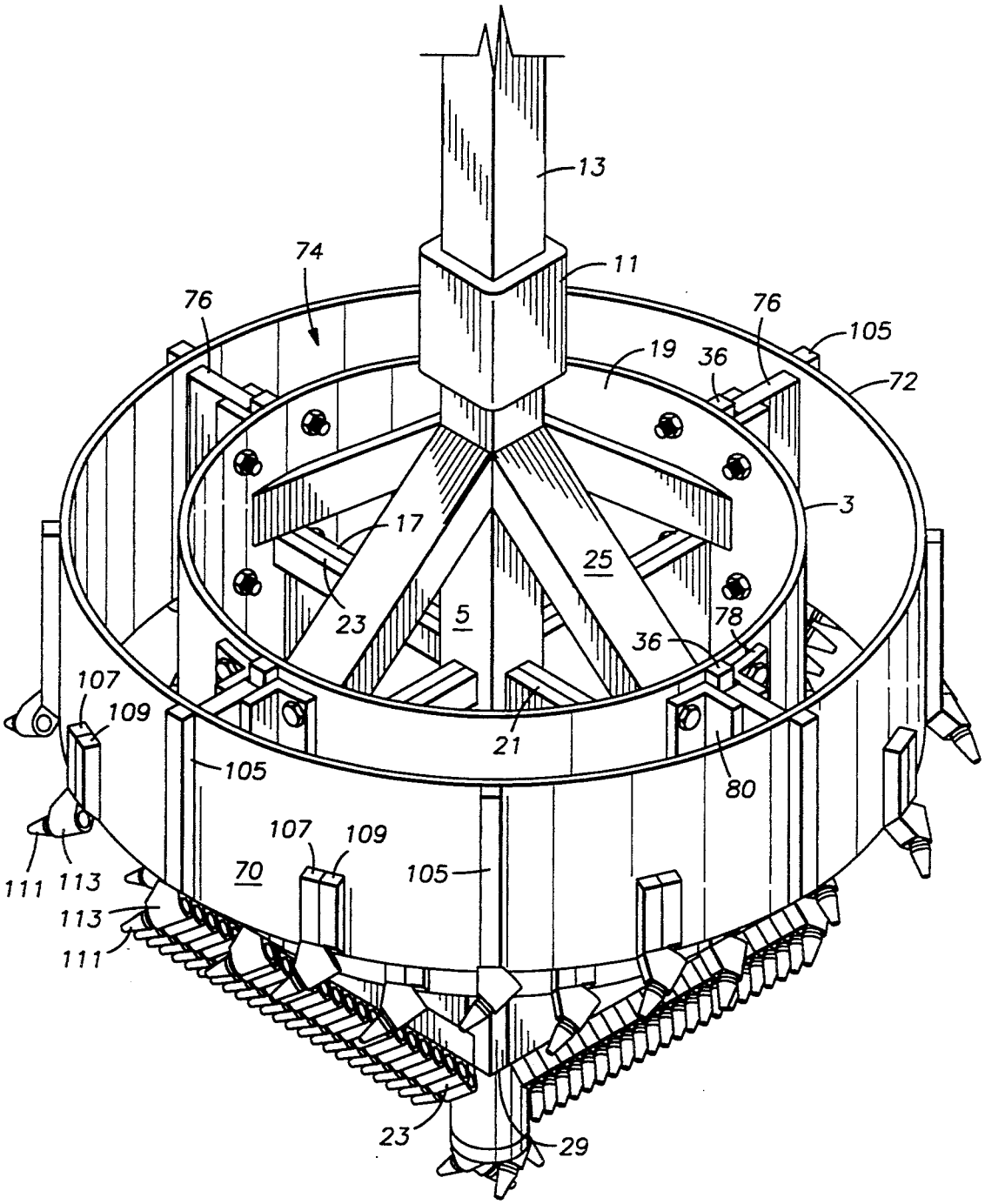
FIG. 2 is an isometric view of the embodiment of the basic rock drill unit of FIG. 1 with the rock drill expander attachment of FIG. 4 mounted thereon, in accordance with the present invention.

When terms such as "upper," "lower," "horizontal," and "vertical" are used herein, reference is made to the rock drill of the present invention when oriented as shown, for example, in FIGS. 1–4, it being understood that such terms are used in their relative senses.

Referring initially to FIG. 1, there is shown in a side elevational view one embodiment of the large diameter rock drill according to the present invention, indicated generally at 1. Rock drill 1 includes a generally circular cylindrical, hollow or tubular metal body 3 preferably having a sidewall thickness which is small as compared to the inner diameter ("ID") and the axial height of the body. The axial height of the body 3 is comparable to, and in a preferred embodiment is approximately the same as, the radius of the body ID, but it can be larger or smaller as desired. The rock drill 1 includes a central metal shaft 5 coaxially disposed within the body 3, and extending longitudinally axially of the body above its top edge 7 and below its bottom edge 9. Shaft 5 is preferably of hollow rectangular or square cross section, but other shapes may be employed. The shaft 5 is relatively thick-walled as compared to its transverse height and width, for providing adequate strength to withstand the torques and other forces imparted to and carried by the shaft in drilling. At the upper end of the shaft 5 there is affixed, as by welding, an enlarged boss 11 which is also preferably of hollow rectangular or square cross section. Other shapes could, of course, be used for the cross section of boss 11, but it is more easily and securely attached to the shaft 5 when the cross sections of 5, 11 correspond with one another.

One end of a drive shaft 13 is attached, as by relatively large or heavy duty pins, bolts, or the like as shown at 15, to the upper end of the boss 11, either inside or outside of the boss. That is, the drive shaft 13 may be inserted into the upper end of the boss 11 as shown in the drawings, or it may be disposed over the boss. In either case, the attachment pins or bolts are preferably disposed in aligned bores in the drive shaft 13 and the boss 11. The other end of the drive shaft 13 is connected to a source of rotary power, such as a drilling rig (not shown), for imparting torque to the shaft 5 through the boss 11 and thereby turning the rock drill 1 in rotary fashion for conducting the drilling operations.

A plurality of substantially vertically disposed plates 17 are attached, as by welding, between the inside wall surface 19 of the body 3 (see FIG. 2) and the exterior surface of the shaft 5. Preferably, four such plates 17 are used, but there could be a larger or smaller number of plates. In the preferred embodiment having four plates 17, they are disposed at substantially 90 degrees to one another. If a greater or lesser number of plates 17 were used, it is preferred that they be substantially equi-angularly disposed about the interior surface 19 of the body 3.

The upper edges 21 of the plates 17 may be substantially fiat and perpendicular to the longitudinal axis of the body 3 and shaft 5 as shown in the drawings, or they may have some other suitable configuration, i.e., tapering or flaring. Plates 17 extend upwardly along the inside wall 19 of body 3 a substantial distance from the lower edge 9, such that the upper edges 21 of plates 17 are disposed in the midportion of the ID of body 3. Preferably, the upper edges 21 of the plates 17 are nearer the upper edge 7 of body 3 than the lower edge 9. Each plate 17 may be provided, if desired, with an upper reinforcing member 23 attached, as by welding, to the plate adjacent to and running along its upper edge 21, from the outside surface of shaft 5 to the inside surface 19 of body 3. Rock drill 1 may also be provided with a plurality of reinforcing struts 25 affixed, as by welding, between the inside wall 19 of body 3 and the outside surface of shaft 5, preferably below boss 11. It is preferred that each strut 25 be disposed in angular alignment with one of the plates 17, in order to keep the spaces between the plates as open and free of obstructions as possible. This permits passage of drilling debris more easily along the body 3 and thus facilitates removal of the rock drill 1 from the hole when drilling is complete, as discussed further below. Struts 25 are preferably of hollow rectangular or square cross-section, similar to the configuration of shaft 5. Struts 25 add structural support and rigidity to the shaft 5, and assist in preventing its being bent, twisted, or broken off during drilling. Struts 25 also substantially reduce the possibility of fatigue failure of the shaft 5. Should the shaft 5 fail or become damaged for any of these reasons, the result could be loss of the rock drill downhole, in turn requiring a costly fishing operation to retrieve it.

Figure 3:
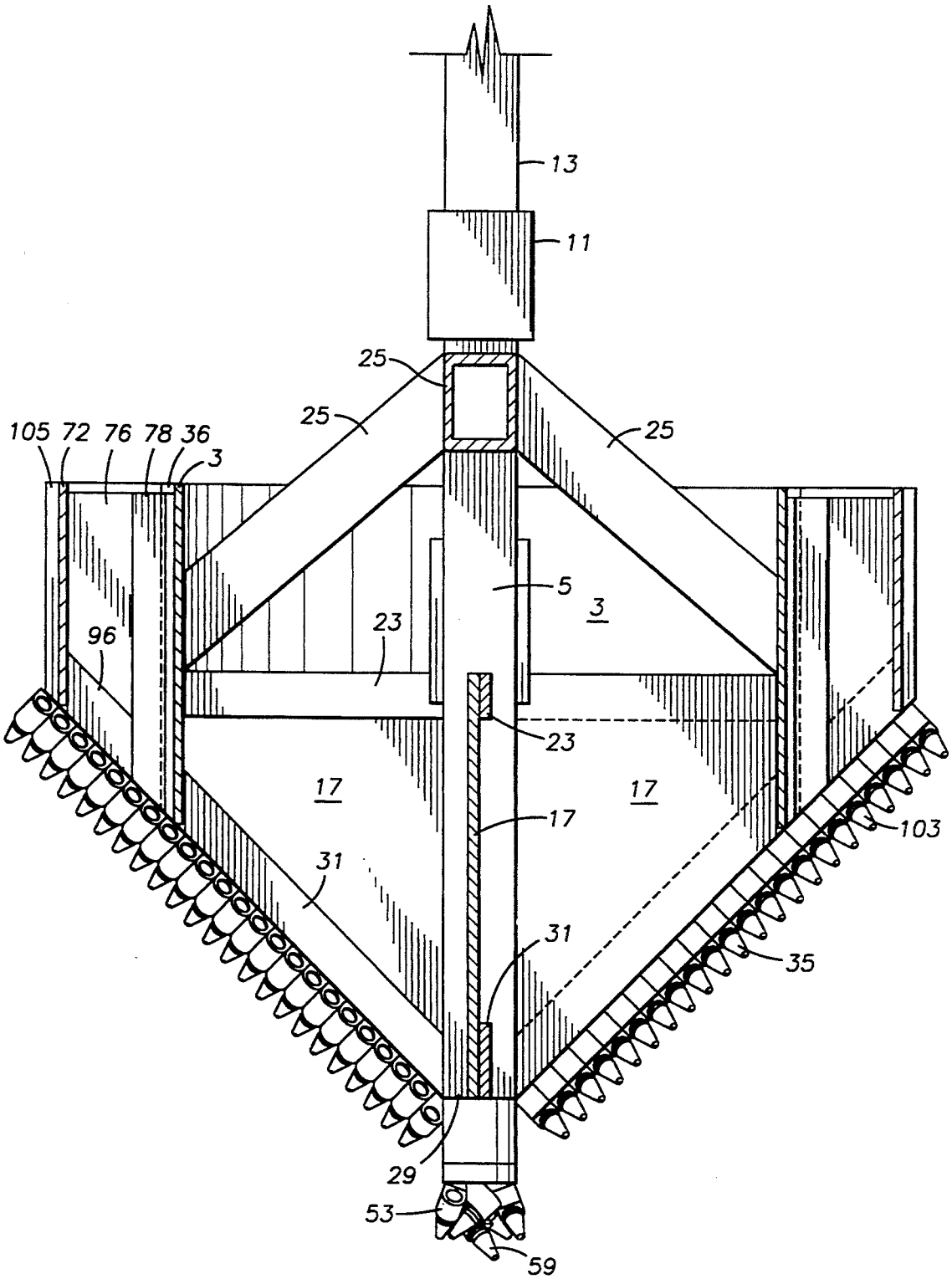
FIG. 3 is a vertical sectional view through the combined apparatus shown in FIG. 2.

The lower edges 27 of the plates 17 each taper downwardly and inwardly from the inside wall 19 of body 3 to the outside surface of shaft 5 near its lower end 29 (see FIGS. 2 and 3). In a preferred embodiment, edges 27 form approximately a forty-five degree angle with the longitudinal axis of the body 3 and shaft 5, but a larger or smaller angle could also be used. Each plate 17 is provided with a lower reinforcing member 31 attached, as by welding, to the plate adjacent to and running along the entire extent of its lower edge 27.

The lower edge 27 of each plate 17 has affixed thereto, again as by welding, a plurality of tooth pockets 33 each having a longitudinally axially extending bore 34 therein for receiving a drill tooth 35, the plurality of drill teeth 35 on each plate 17 thus forming a substantially linear array. The tooth pockets 33 are welded to the lower edges of the reinforcing members 31 and to the adjacent lower edges 27 of the plates 17, which edges are substantially flush with one another and which together form a relatively thick, firm, solid base to which the pockets 33 may be securely affixed. The pockets 33 are preferably closely packed together and welded to one another as well as to the plates 17 and reinforcing members 31, thus increasing the strength of the array of pockets so that they will not easily become dislodged from the rock drill or bent out of line during drilling. The radially outermost pocket **33*a* of each array may also be affixed, as by welding, to one of a plurality of vertically extending, radially outwardly projecting ribs 36, which are also welded to the outside wall of body 3. Ribs 36 preferably extend along the entire axial height of the body 3, and like the plates 17 are preferably equi-angularly spaced about the body 3. In a preferred embodiment, there are four such ribs 36, spaced apart at 90-degree intervals and in angular register with the plates 17**.

All of the pockets 33 and teeth 35 disposed on the plates 17, reinforcing members 31 and ribs 36 face generally downwardly and outwardly, and are angled with respect to both the plates 17 and the body 3 toward the same general direction. i.e., clockwise or counterclockwise, depending on the intended direction of rotation of the rock drill 1 so that the teeth 35 may dig properly into the earth and rock during drilling. As shown in the drawings, for example, the teeth 35 point downwardly, outwardly, and in a clockwise direction to accommodate clockwise rotation of the rock drill 1 during drilling.

Figure 5:
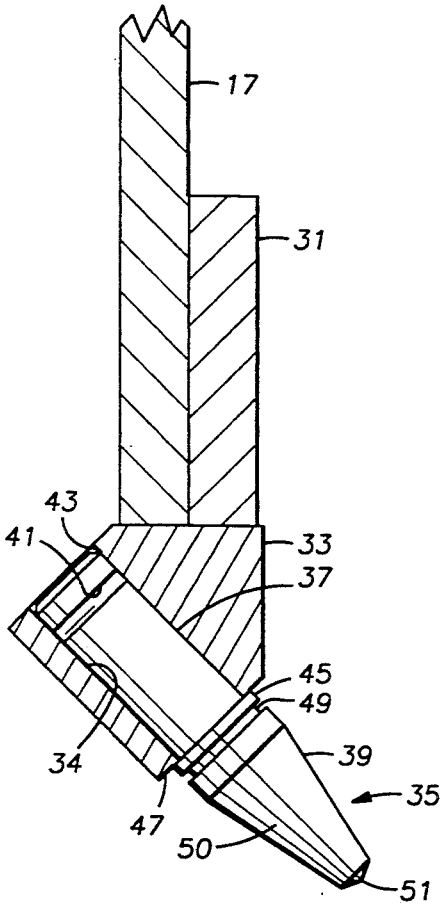
FIG. 5 is an enlarged, fragmentary sectional view, partly in elevation, of one of the pockets and drill teeth of the present invention, taken along the lines 5—5 of FIG. 1 and FIG. 13.
Figure 6:
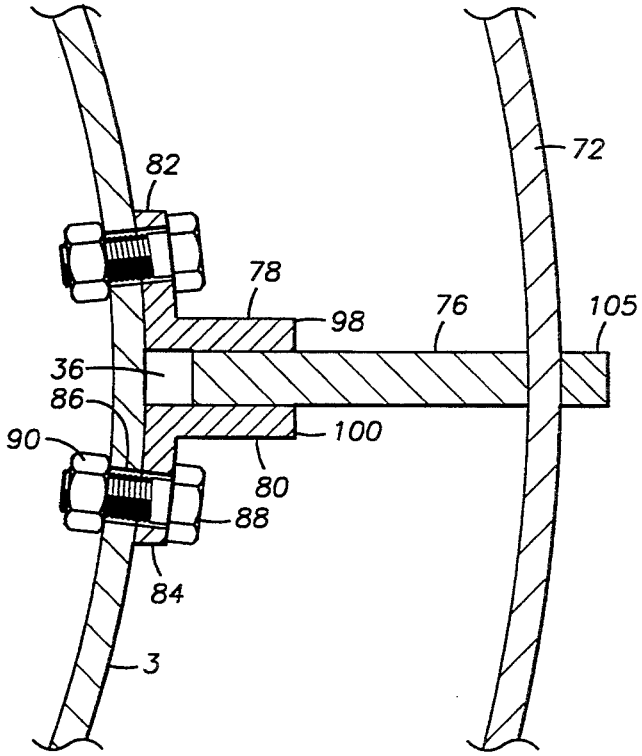
FIG. 6 is an enlarged, fragmentary sectional view, partly in elevation, of one of the spacers and its associated connecting flanges which are used to mount the embodiment of the rock drill expander attachment referred to above to the embodiment of the basic rock drill unit of the present invention referred to above.
Figure 11:
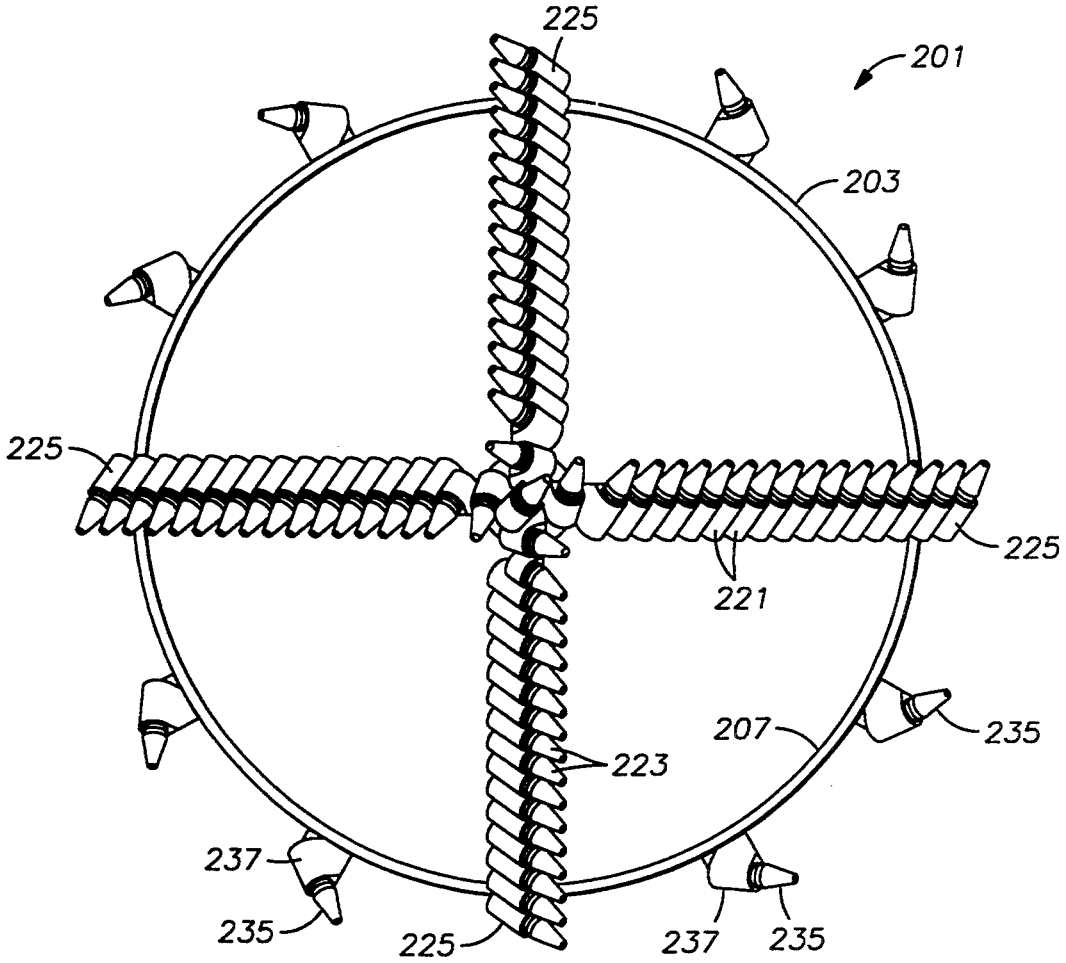
FIG. 11 is a bottom plan view of an alternative embodiment of the basic rock drill unit of the present invention.
Figure 12:
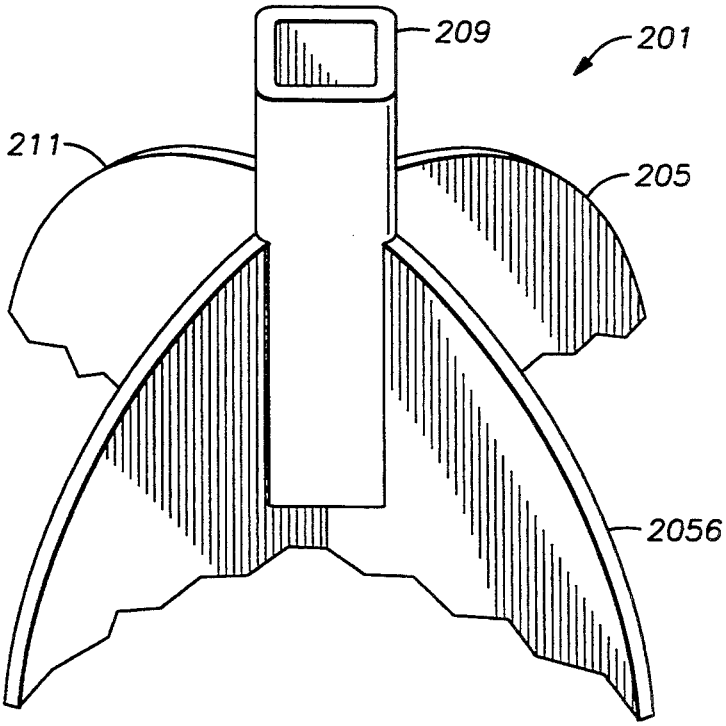
FIG. 12 is a fragmentary isometric view of the upper end portion of the alternative embodiment of the basic rock drill unit shown in FIG. 11.

As shown in more detail in FIG. 5, teeth 35 each comprise a substantially circular cylindrical shank 37 housed in the bore 34 of its respective pocket 33, and a cutting head or tip 39 which is integral with the shank and extends below the pocket. The OD of the shank 37 and the diameter of the bore 34 are sized such that each tooth can be press fitted into a bore 34. An annular groove 41 is disposed around the shank 37 near its upper end, and the shank is tapered around its upper circumferential edge 43 to facilitate insertion of the tooth into the pocket. Head or tip 39 includes an annular shoulder 45 which is larger in outside diameter than the diameter of bore 34, and which abuts against the lower flat lace 47 of the pocket 33 around the bore. An annular groove 49 is disposed around the cutting head 39 adjacent to the shoulder 45. Below the groove 49, cutting head 39 is of a generally steep conical configuration as shown at 50, terminating in a flatter conical pointed tip 51. Teeth 35 may rotate in their bores 34 during drilling, so that any wear on the teeth may be relatively evenly distributed around their circumferences. Teeth 35 are preferably made of a hard, drilling-quality metal such as tungsten carbide or the like, which materials are well known in the art. A pilot drill 53 is mounted on the lower end of the shaft 5, and includes a cylindrical body portion 55 and a drill tip portion 57. Cylindrical body portion 55 is welded, threaded, or otherwise affixed to the shaft 5, and drill tip portion 57 is similarly welded, threaded, or otherwise affixed to the cylindrical body portion 55. Drill tip portion 55 includes a plurality of bores for receiving a like plurality of pilot teeth 59 which are similar to teeth 35. Pilot teeth 59 are press-fit into the bores in the drill tip portion 57, and point generally downwardly and outwardly. The pilot teeth 59 are also arranged in a circular-type pattern such that they point in the same general direction, i.e., clockwise or counterclockwise, as the teeth 35. Pilot drill 53 assists in breaking the ground at the desired location and angle in order to properly kick off the drilling operations.

Body 3 of rock drill 1 also includes a plurality of body teeth 61 received in-pockets 63 mounted on the lower circumferential outer periphery of the body, between the vertically extending ribs 36. Body teeth 61 and pockets 63 are like teeth 35 and pockets 33 disposed on plates 17, reinforcing members 31 and ribs 36. Pockets 63 are affixed, as by welding, to pairs of vertically extending, radially outwardly projecting supports 65, 67, which are welded to one another and to the outside wall of body 3. Supports 65, 67 preferably extend along only a portion, for example less than half, of the axial height of the body 3. In a preferred embodiment, the supports 65, 67 are equi-angularly spaced apart on the body 3 between the ribs 36, for example at 30-degree intervals.

Like the teeth 35 and the pockets **33, 33*a*, all of the pockets 63 and teeth 61 face generally downwardly and outwardly, and are angled with respect to the body 3 in either a clockwise or counterclockwise direction, depending on the intended direction of rotation of the rock drill 1. Like the teeth 35, teeth 61 shown in the drawings point downwardly, outwardly, and in a clockwise direction to accommodate clockwise rotation of the rock drill 1** during drilling.

In order to maximize the number of teeth 35 engaging the earth and rock during drilling, the teeth in adjacent arrays are offset from one another by an amount which results in substantially each tooth cutting around a unique circular path as the rock drill is rotated. For example, consider that the pocket 33 for the lowermost, or radially innermost, tooth 35 on a selected plate 17 is placed immediately adjacent the shaft 5, at the "zero" position. The lowermost tooth 35 on the next succeeding plate 17 is then spaced one-half inch, for example, from the shaft 5; the lowermost tooth 35 on the second succeeding plate 17 is spaced one inch, for example, from the shaft 5; the lowermost tooth 35 on the third succeeding plate 17 is spaced one-and-one-half inches, for example, from the shaft 5. Returning to the first selected plate 17, the second tooth 35 on that plate would then be spaced two inches from the shaft 5, and so on. On any particular plate 17, the teeth 35 would then be on two inch spacing all the way out to the radially outermost tooth in pocket **33*a*, and there would be a one-half inch offset, either toward or away from the shaft, between these teeth and the teeth on the two neighboring plates 17**.

This configuration of teeth 35 is illustrated schematically in FIG. 10, where two teeth **35*b*, 35*c* of a selected plate 17 have been shown in elevation. The spacing between the tips 51*b*, 51*c* of these two teeth, in a preferred embodiment, is about two inches. If the rock drill 1 having teeth 35*b*, 35*c* were rotated 90 degrees so that the next succeeding plate 17 is brought into the plane of the drawing, the tooth 35*d*, corresponding in position in its array to that of tooth 35*b* (that is, both teeth 35*b* and 35*d* are the second teeth, or the third teeth, or the like in their arrays), would occupy the position shown in phantom lines for tooth 35*d* in FIG. 10. In a preferred embodiment, the distance between the tip of tooth 35*d* as shown and tip 51*b* is about one-half inch. If the rock drill 1 were rotated another 90 degrees in the same direction, the tooth 35*e*, also corresponding in position in its array to that of tooth 35*b*, would occupy the position shown in phantom lines for that tooth in FIG. 10. In a preferred embodiment, the distance between the tip of tooth 35*e* and tip 51*b* is about one inch. Similarly, tooth 35*f* on the next succeeding plate 17, also corresponding in position in its array to the position of tooth 35*b*, would occupy the position shown in phantom lines for that tooth if the rock drill were rotated another 90 degrees in the same direction. In a preferred embodiment, the distance between the tip of tooth 35*f* and tip 51*b* is about one-and-one-half inches. As indicated in FIG. 10, the offset between tooth 35*f* and tooth 35*c*** is also about one-half inch.

As a result of this unique configuration of teeth 35, a separate tooth located on one of the plates 17 engages the earth about every one-half inch from the radially innermost tooth to the radially outermost tooth during drilling. The effect of this spacing is to have a plurality of substantially concentric circles, spaced about one-half inch apart, being cut substantially simultaneously into the soil and rock as the rock drill 1 bores into the earth.

In the event that a larger hole is desired than the one drilled by the basic rock drill unit 1 shown in FIG. 1, the present invention also includes a drill expander attachment 70 which may be quickly and easily attached to the basic rock drill unit 1 in order to enlarge the effective drilling diameter of the invention. As shown in FIGS. 2, 3, 4, 6, and 7, the drill expander attachment 70 includes a generally circular cylindrical, hollow or tubular metal body 72 preferably having about the same sidewall thickness as body 3, but having a larger OD and ID thereby creating an annular space 74 between the bodies 3, 72. The diameter of the body 72 can be varied, depending on the diameter of the hole the operator desires to drill. The axial height of the body 72 is less than that of body 3, in order to permit the teeth 35 of body 3 to extend below body 72 when the bodies are assembled, as further described below. In the assembled configuration, the upper edges of the bodies 3, 72 are preferably flush with one another.

Body 72 includes a plurality of radially projecting, circumferentially spaced apart, substantially vertically disposed spacer members 76 welded or otherwise affixed to the ID wall of the body. Spacer members 76 are preferably equi-angularly spaced apart around the ID of the body 72 so as to be substantially in angular or radial register with the plates 17 disposed on body 3. Two L-shaped flanges 78, 80 are welded or otherwise affixed to the opposite sides of each of the spacers 76 along their radially inner edges. One leg 82, 84 of each flange 78, 80 is adapted to be attached to the OD wall of body 3, and is shaped to conform to the curvature of body 3 as shown particularly in FIG. 6. The legs 82, 84 of flanges 78, 80 and the body 3 are provided with a plurality of radially extending holes 86, which may be located, for example, in axially spaced apart positions near the upper and lower edges of the flanges and the body 3, in which bolts 88 are received. Bolts 88 are then secured by nuts 90 for removably attaching body 72 to body 3. The thickness of the spacer members 76 is such as to permit the ribs 36 disposed on body 3 to be housed in the space between flanges 78, 80 when the flanges are attached to the body 3.

Figure 4:
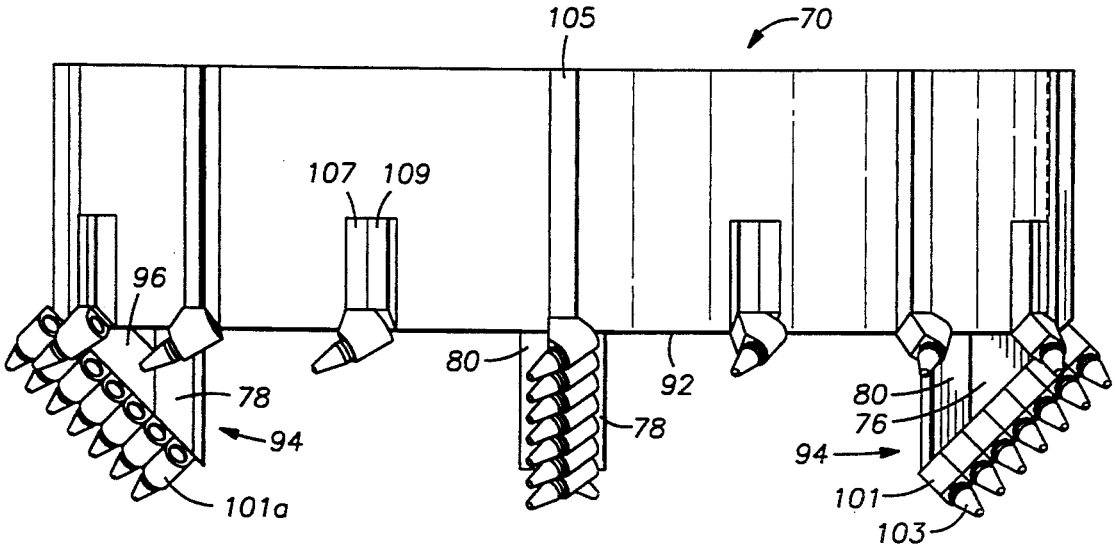
FIG. 4 is an elevational view of one embodiment of the rock drill expander attachment of the present invention.

The spacer members 76 and flanges 78, 80 extend below the bottom edge 92 of body 72 as shown particularly in FIG. 4. The radially innermost laces 94 of flanges 78, 80 preferably extend along the full axial height of the body 3 when the bodies 3, 72 are assembled. The lower faces or edges of the flanges 78, 80 and the spacer members 76 are tapered at substantially the same angle as the lower edges of plates 17, so as to appear as coplanar extensions of such lower edges when the bodies 3, 72 are assembled. A reinforcing member 96 may be affixed to the lower portion of each of the spacer members 76, on one or both sides thereof, so that it extends along the lower edges of the spacers 76 between the radially outermost faces 98, 100 of one or both of the flanges 78, 80, and the ID wall of the body 72.

A plurality of pockets 101 are welded to the lower aces or edges of spacers 76, flanges 78, 80, and reinforcing members 96 for receiving a like plurality of teeth 103 which are oriented in substantially the same angular positions and directions with respect to body 72 as are pockets 33 and teeth 35 with respect to body 3. Pockets 101 and teeth 103 are like pockets 33 and teeth 35, so they need not be described further here. When the bodies 3, 72 are assembled, the radially innermost (and axially lowermost) pocket 101*a* of each array on body 72 is disposed immediately adjacent to the radially outermost (and axially uppermost) pocket 33*a* of the corresponding array on body 3. The teeth on body 72 are offset in the same fashion as the teeth 35 on body 3, so there is usually only one angular position of body 72 on body 3 which will enable the two bodies to be assembled; otherwise, the teeth on at least one array of body 3 will interfere with the teeth on at least one array of body 72. When the bodies 3, 72 are assembled, the arrays of teeth 103 on body 72 are essentially continuations of the arrays of teeth 35 on body 3, so that when the combined bodies 3, 72 are viewed from below as in FIG. 8, four substantially continuous arrays of teeth 35, 103 will appear.

The radially outermost pocket 101*a* of each array on body 72 may also be affixed, as by welding, to one of a plurality of vertically extending, radially outwardly projecting ribs 105, which are also welded to the outside wall of body 72. Ribs 105 preferably extend along the entire axial height of the body 72. There may be additional ribs 105 disposed between the ribs to which pockets 101*a* are affixed, and they are preferably equi-angularly spaced about the body 72. In a preferred embodiment, there are eight such ribs 105, spaced apart at 45-degree intervals. Four of such ribs 105 are thus in register with the spacer members 76, the ribs 36 and the plates 17, and the other four such ribs are disposed halfway between each adjacent pair of such first four ribs. In addition, between each pair of adjacent ribs 105, pairs of vertically extending, radially outwardly projecting supports 107, 109 are welded to one another and to the outside wall of body 72. Supports 107, 109 preferably extend along only a portion, for example half or less than half, of the axial height of the body 72. In a preferred embodiment, there are eight pairs of supports 107, 109, and they are equi-angularly spaced apart on the body 72 between the ribs 105, for example at 45-degree intervals.

Body 72 of rock drill expander attachment 70 also includes a plurality of body teeth 111 received in pockets 113 mounted on the lower circumferential outer periphery of the body 72, between the four vertically extending ribs 105 which are in register with spacers 76. Body teeth 111 and pockets 113 are like teeth 35, 61, 103 and pockets 33, 63, 101 and are affixed, as by welding, to ribs 105 or supports 107, 109, as the case may be. Pockets 113 and body teeth 111 face generally downwardly and outwardly, and are angled with respect to the body 72 in either a clockwise or counterclockwise direction, depending on the intended direction of rotation of the combined rock drill 3, 72. Like the body teeth 61, body teeth 111 shown in the drawings point downwardly, outwardly, and in a clockwise direction to accommodate clockwise rotation of the combined rock drill 3, 72 during drilling.

The following are some typical dimensions of the present invention. These dimensions are intended to be illustrative only, and are not intended to be, nor are they, limiting in any way. The diameter of the rock drill 1, without the extension or expander 70, will typically be in the range of 24 inches to 48 inches, but of course the rock drill may have any other diameter, larger or smaller, depending on the intended use of the device. The diameter of the expander 70 typically will be about 48 inches to about 72 inches, but again, larger or smaller expander sections may be used. In a preferred embodiment, the expander 70 may be about 66 inches in diameter. The axial height of the body 3 may be between about 18 inches and 36 inches, and in a preferred embodiment may be about 24 inches. The axial height of the body 72 may be between about 12 inches and about 24 inches, and in a preferred embodiment may be about 20 inches. The support members 65, 67 and 107, 109 and the ribs 36, 105 may be made from bar stock about $1\frac{1}{4}$ inches square. Struts 25 may be made from metal having a wall thickness of about $\frac{3}{8}$ inch, and the outside dimensions of the struts may be about 3 inches by 2 inches. Bodies 3, 72 may have a wall thickness of about $\frac{5}{8}$ inch, and the plates 17 may have a thickness of about 1 inch. The reinforcing members 31, 23 may also have a thickness of about 1 inch.

Figure 13:
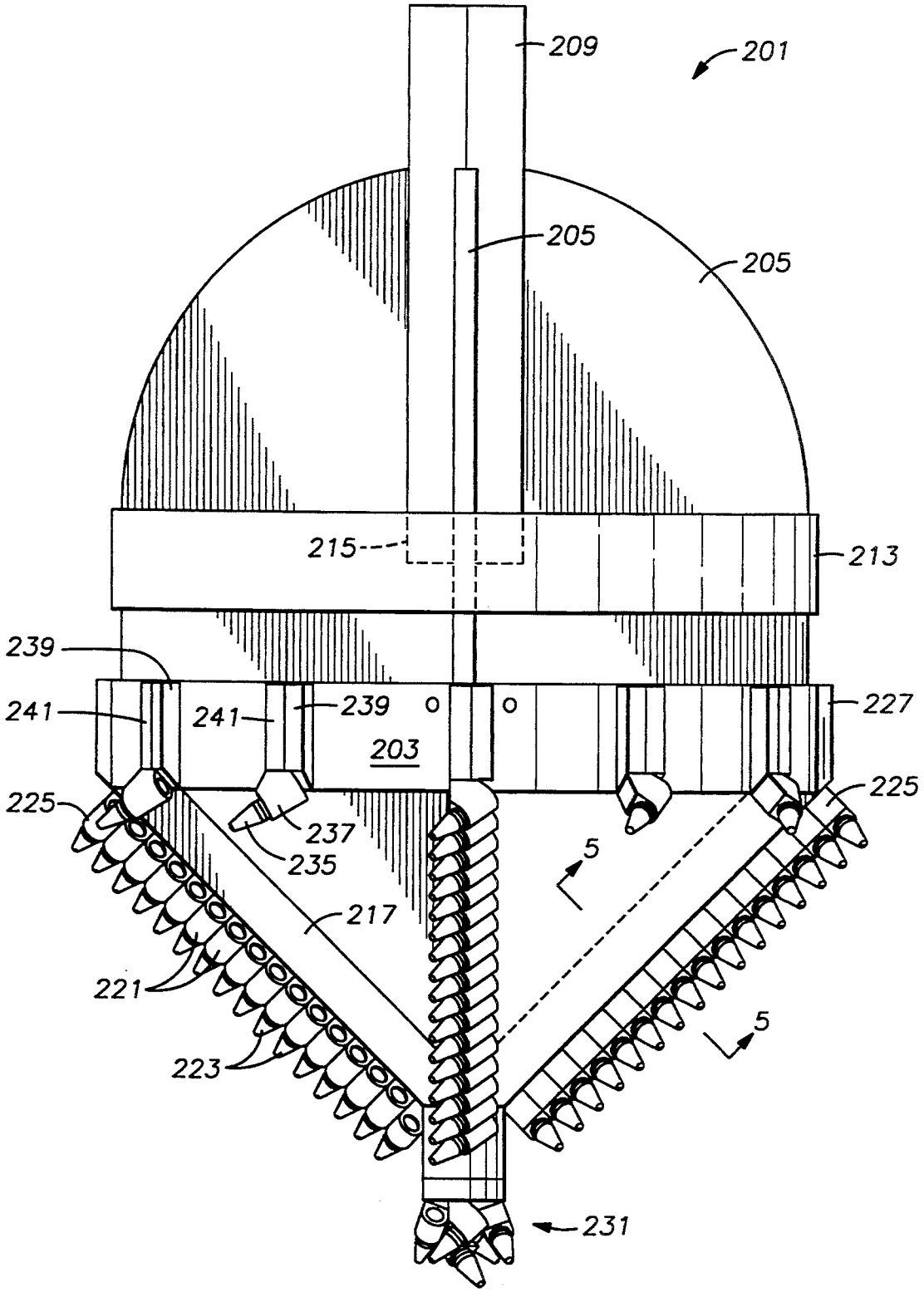
FIG. 13 is an elevational view of the alternative embodiment of the basic rock drill unit shown in FIGS. 11 and 12.
Figure 14:
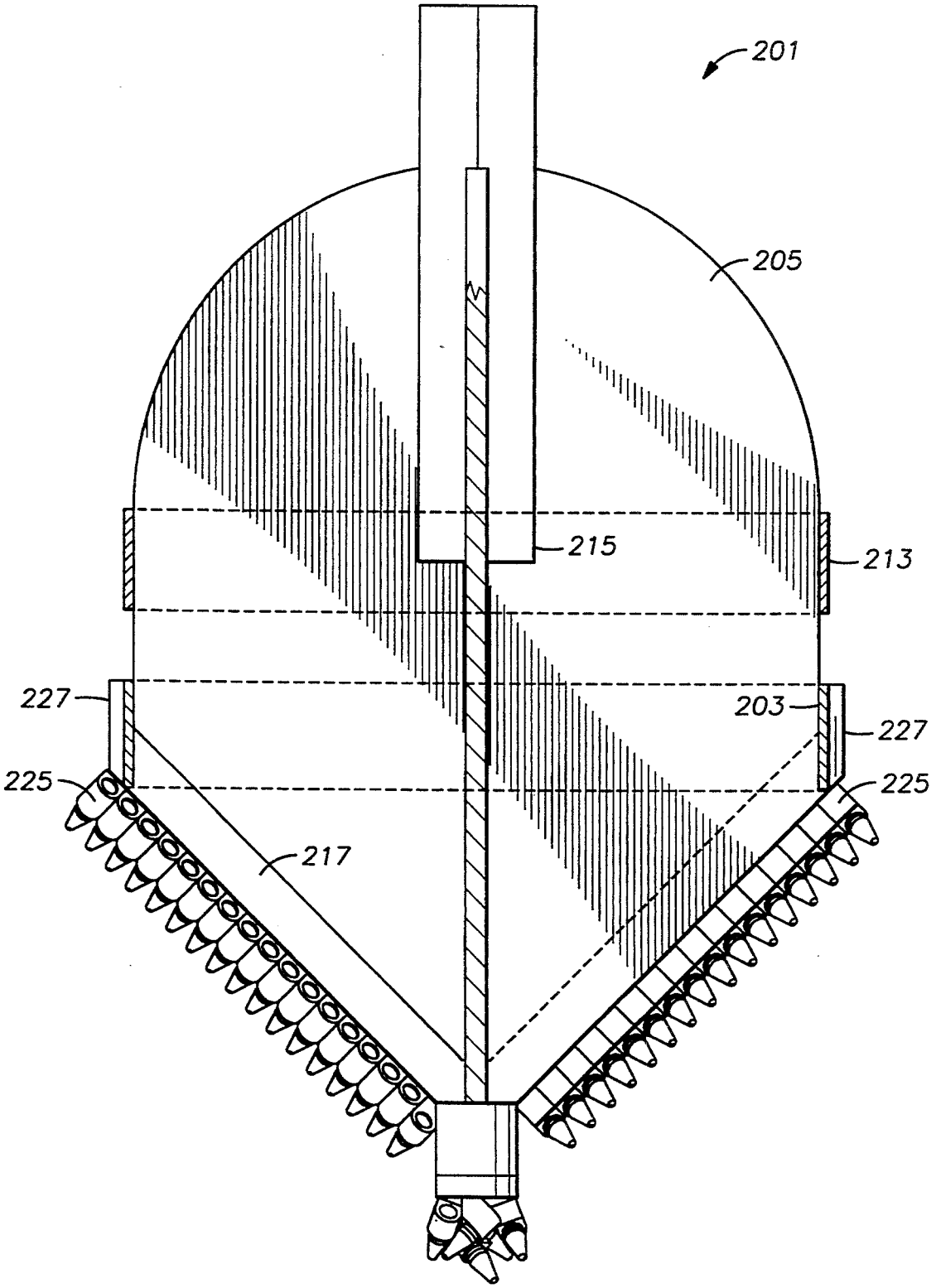
FIG. 14 is a vertical sectional view of the alternative embodiment of the basic rock drill unit shown in FIGS. 11–13.

Referring now to FIGS. 11–14, there is shown an alternative embodiment of the basic rock drill unit of the present invention, indicated generally at 201. According to this alternative embodiment, the basic rock drill unit of the large diameter rock drill includes an annular drill ring body 203 of generally circular cylindrical, hollow or tubular configuration within which are disposed a plurality of substantially vertically disposed plates 205. Plates 205 extend both above and below the annular drill ring body 203, and are attached to its inside wall surface 207. The plates are affixed to one another, as by welding, along the central longitudinal axis of the rock drill unit 201 from its midportion to its lower end portion. At the upper end portion of the rock drill unit 201, plates 205 are affixed to a central, coaxially disposed shaft 209, which extends longitudinally axially above the topmost edges 211 of the plates 205. Shaft 209 is adapted for attachment to a drilling rig or other drive means for rotating the rock drill. An annular reinforcing ring 213 surrounds and is affixed to the radially outermost edges of plates 205 above the annular drill ring body 203. The reinforcing ring 213 also surrounds the lower end portion 215 of shaft 209, as shown in FIGS. 13 and 14.

The lower edges of plates 205 each taper downwardly and inwardly from the inside wall 207 of annular drill ring body 203 toward the central longitudinal axis of the rock drill unit 201. Each plate 205 is provided with a lower reinforcing member 217 mounted on the plate adjacent to and running along its lower edge. The lower edges of the plates 205 and attached reinforcing members 217 have a plurality of tooth pockets 221 mounted thereon, each pocket receiving a drill tooth 223, the plurality of drill teeth 223 on each plate 205 forming a substantially linear array in substantially the same fashion as the arrays of teeth 35 on plates 17 of the first embodiment described above. As in the first embodiment, in this alternative embodiment 201 the pockets 221 are closely packed together and attached to one another as well as to the plates 205 and reinforcing members 217. In this alternative embodiment, as in the first, the radially outermost pocket 225 of each array is affixed to one of a plurality of vertically extending, radially outwardly projecting ribs 227 disposed on the annular drill ring body 203. Preferably there are four such ribs 227 spaced apart at 90-degree intervals and in angular register with the plates 205.

All of the pockets 221 and teeth 223 disposed on the plates 205 and ribs 227 in this alternative embodiment 201 face or are "aimed," and angled, in the same general manner as the pockets 33 and drill teeth 35 in the first embodiment. A pilot drill 231 like that described above for the first embodiment is longitudinally axially mounted on the rock drill 201 at its lower end, to the lower edges of plates 205.

The annular drill ring body 203 also includes a plurality of drill teeth 235 mounted on its lower circumferential outer periphery between the vertically extending ribs 227, like the body teeth 61 in the first embodiment. These teeth 235 are disposed in pockets 237 mounted on pairs of vertically extending, radially outwardly projecting supports 239, 241 affixed to the annular drill ring body 203, again like the supports 65, 67 in the first embodiment described above. Such body teeth 235 are aimed and angled in like manner as the body teeth 61 in the first embodiment.

The teeth 235 in adjacent arrays of this alternative embodiment are offset from one another in like manner as those in the first embodiment, and as shown schematically in FIG. 10.

The upper edges of the plates 205 are shown to be shaped like quarter circles, but of course other shapes could be used for the upper edges of the plates, such as tapered, square, or the like.

The rock drill 201 of the alternative embodiment may also be used with an expander ring to increase the size of the borehole to be drilled. In this event, bolt holes such as that shown at 241 (FIG. 13) may be provided in drill ring body 203 to permit attachment of an appropriately configured expander ring to the body, as by nuts and bolts such as shown at 88, 90 in the first embodiment.

In both the first and the alternative embodiments, the distance of the pilot drill from the lowermost drill teeth of the arrays on the plates call be adjusted from the spacing shown in the drawings, which of course are intended to be illustrative only. For example, by placing the pilot drill closer to the lowermost teeth in the arrays, thereby reducing the gap between the pilot drill teeth and the teeth in the arrays, it may be possible to increase the rate of penetration of the rock drill. By eliminating gaps between the pilot drill teeth and the teeth in the arrays, a more continuous grouping of teeth can be presented against the rock or earth to be drilled, and a smoother overall grinding effect can be achieved.

The rock drill of the present invention preferably has four angularly spaced apart arrays of teeth which are properly aimed, angled and offset as discussed above (for both illustrated embodiments) such that each tooth of an array engages the hole at a different location than other teeth in both its array and other arrays. As stated above, this maximizes the number of teeth engaging the bottom of the hole at any given moment during drilling. In addition, properly aimed and angled teeth disposed on the circumferential periphery of the rock drill body assist in the rapid drilling operations, for example by enlarging the hole enough to create a clearance between the wall of the bore being drilled and the OD of the rock drill body. The ribs 36, 105, 227 and the support members 65, 67, 107, 109, and 239, 241 assist in preventing the formation of a vacuum between the body of the drill and the borehole, which vacuum could cause the sticking of the drill in the hole and substantially slow its progress. The ribs 36, 105, 227 and the support members 65, 67, 107, 109, and 239, 241 also serve as wear bars by engaging the borehole wall and reducing contact of the bodies 3, 72, 203 against the borehole wall, thereby reducing wear on the bodies as a result of such contact. Furthermore, the ribs 36, 105, 227 and the support members 65, 67, 107, 109, and 239, 241 assist in centering the rock drill in the borehole. The axial height of the bodies 3, 72, 203, and the reinforcing ring 213 in the alternative embodiment, also helps to keep the rock drill centered in the borehole by reducing tilting or canting of the bit. It thus acts as a stabilizer by helping to keep the rock drill of the present invention true in the hole, and helping to keep it from wandering.

After the rock drill of the present invention has been used to drill through a substantial depth, for example 10 to 12 feet of rock, there will be a large volume of cuttings or crushed or loose material accumulated above the bit. Unlike the case with prior art flighted bits, however, the present invention has no flights on which the accumulated loose material can rest and weigh down the bit. With the present invention the bit is simply picked up and the loose material passes through the substantial spaces in the body 3 between the plates 17 and struts 25, and the substantial spaces between the bodies 3, 72 and spacers 76, in the first embodiment. As seen, for example, in FIG. 2, there are relatively large spaces for the loose material to pass through the rock drill as it is being pulled from the hole. As for the second or alternative embodiment, the loose material passes through the large spaces between the plates 205 and the body 203 and reinforcing ring 213. This reduces, over prior art drilling rigs, the amount of power required in the rig to pull the rock drill from the hole. In addition, with prior art flighted bits, pulling out of the hole with a large volume (and thus great weight) of accumulated material on top of the bit unduly stresses the bolts or other fasteners attaching the bit to the drive means. This sometimes results in breaking of the fasteners and loss of the bit downhole, thereby necessitating a fishing expedition to retrieve it. With the present invention, the bolts or other fasteners are not so stressed when the bit is picked up because the bit does not pick up all the loose material with it; this significantly reduces the chances of losing a bit downhole.

After the rock drill of the present invention is pulled from the hole, it may be replaced with an auger-type cleanout tool (not shown) for removing all the cuttings and loose material from the borehole. The rock drill of the present invention can then be placed back in the drill string rig and drilling operations resumed.

Another method of hole cleanout may be found quite advantageous particularly when the alternative embodiment 201 of the rock drill of the present invention is being used. In many cases, drilling of boreholes such as those described herein will take place with the assistance of high-pressure fluids such as water applied downhole, and with an accumulated depth of fluid or water in the borehole. In such cases, when an appropriate depth of hole has been drilled, the downhole pressure can be slacked off, and the rock drill 201 rotated at increased speed. As the speed of rotation of drill 201 increases, a paddlewheel or whirlpool effect is created whereby the water is thrown or swirls to the outside of the borehole, leaving a vacated area in its center, and the cuttings and tailings are carried to the sides of the hole and up the sides toward the surface. As the whirlpool effect increases, sometimes the bottom of the hole can be seen from the surface. This whirlpool or paddlewheel action effectively cleans the borehole, and in this case an auger-type cleanout tool would not have to be used.

A rock drill according to the present invention has been found to drill effectively at a substantially increased speed and efficiency over what has been the typical experience with prior art drills. The present invention is capable of substantially reducing the time required to drill a hole. For example, holes which in the past have required many hours (for example, from about 17 to about 27 hours) to drill with prior art drills, can be drilled with the present invention in a fraction of the time, often in 2 hours or less. In addition, less horsepower is required from the drilling rig when using the present invention. Typically only half, or less than half, of the prior art horsepower requirements will be needed on a rig when using the present invention. Overall, the present invention is capable of drilling the same sized hole with increased speed, using lower torque and horsepower from the rig (and thus perhaps a smaller drilling rig), with greater accuracy and less wandering than experienced with typical prior art dock drills. The present invention is also strong, durable, relatively easy to manufacture, and easy to use. All of the foregoing give the rock drill of the present invention a significant advantage over prior art drills used for drilling large diameter holes.

While preferred and alternative embodiments of the invention have been shown and described, many modifications thereof may be made by those skilled in the art without departing from the spirit of the invention. Therefore, the scope of the invention should be determined in accordance with the following claims.

I claim:

1. A large diameter rock drill, comprising:

an annular body having an inside wall, and upper and lower edges;

a central shaft longitudinally axially disposed with respect to said body and having an upper end, said shaft extending longitudinally axially of said body above its upper edge, said upper end of said shaft being adapted for attachment to a source of rotary power for rotating the drill;

a plurality of radially extending, angularly spaced apart plates attached to said inside wall of said body and said shaft each of said plates having a lower edge, which tapers downwardly and inwardly from said inside wall of said body toward the longitudinal is of the drill near its lower end, each of said lower edges of said plates having a plurality of tooth pockets mounted thereon in a substantially linearly, each of said tooth pockets being adapted for removably receiving a drill tooth therewithin; and a plurality of vertically extending, radially outwardly projecting ribs disposed on said body.

2. The large diameter rock drill of claim 1, wherein each of said ribs is in angular register with one of said plates and has a lower end disposed near said lower edge of said body, and the radially outermost pocket of each array is affixed to said lower end of the adjacent one of said ribs.

3. The large diameter rock drill of claim 1, wherein said upper end of said shaft and at least one of said plates extend above said upper edge of said body.

4. A large diameter rock drill, comprising:

an annular body having an inside wall, and upper and lower edges;

a central shaft longitudinally axially disposed with respect to said body and having an upper end, said shaft extending longitudinally axially of body above its upper edge, said upper end of said shaft being adapted for attachment to a source of rotary power for rotating the drill;

a plurality of radially extending, angularly spaced apart plates attached to said inside wall of said body and said shaft, each of said plates having a lower edge which tapers downwardly and inwardly from said inside wall of said body toward the longitudinal axis of the drill near its lower end, each of said lower edges of said plates having a plurality of tooth pockets mounted thereon in a substantially linear array, each of said tooth pockets being adapted for removably receiving a drill tooth therewithin; and a plurality of body tooth Its mounted around the outer circumferential periphery of said body near said lower edge of said body, each of said body tooth pockets being adapted for removably receiving a drill tooth therewithin.

5. The large diameter rock drill of claim 4, wherein said body tooth pockets are oriented such that the drill teeth point downwardly, outwardly, and in a single circular direction when received in said body tooth pockets.

6. The large diameter rock drill of claim 5, wherein said pockets disposed on said plates are oriented such that the drill teeth, when disposed therewithin, point downwardly, outwardly, and in the same circular direction as the drill teeth received in said body tooth pockets.

7. A large diameter rock drill, comprising:

an annular body having an inside wall, and upper and lower edges;

a central shaft longitudinally axially disposed with respect to said body and having an upper end, said shaft extending longitudinally axially of body above its upper edge, said upper end of said shaft being adapted for attachment to a source of rotary power for rotating the drill;

a plurality of radially extending, angularly spaced apart plates attached to said inside wall of said body and said shaft, each of said plates having a lower edge which tapers downwardly and inwardly from said inside wall of said body toward the longitudinal axis of the drill near its lower end, each of said lower edges of said plates having a plurality of tooth pockets mounted thereon in a substantially linear array, each of said tooth pockets being adapted for removably receiving a drill tooth therewithin and each of said pockets being oriented such that the drill teeth point downwardly, outwardly, and in a single circular direction when received in said pockets; and said body being a basic unit body, and further including a drill expander attachment removably mountable around said basic unit body for enlarging the effective drilling diameter of the drill, said drill expander attachment including a substantially circular tubular expander body having an inside wall, upper and lower edges, a greater diameter and a smaller axial height than the basic unit body; a plurality of radially extending, angularly spaced apart spacer members mounted on said inside wall of said expander body, said spacer members having attachment means disposed on their radially inner portions for removable attachment to said basic unit body; said arrays of pockets disposed on said plates extending below said lower edge of said expander body, and said spacer members being substantially in angular register with said plates disposed on said basic unit body, when said expander body is mounted around said basic unit body; said spacer members and said attachment means extending below said bottom edge of said expander body, and having lower edges which are tapered at substantially the same angle as said lower edges of said plates of said basic unit body; and a plurality of pockets mounted in a substantially linear array on said lower edges of said spacer members and said attachment means for receiving a like plurality of drill teeth which are oriented in substantially the same angular positions and directions with respect to said expander body as are said pockets and drill teeth of said basic unit body with respect thereto.

8. The large diameter rock drill of claim 7, wherein the radially innermost and axially lowermost pocket of each array of pockets on said expander body is disposed immediately adjacent to the radially outermost and axially uppermost pocket of the corresponding array on the basic unit body when the expander body is mounted around the basic unit body.

9. The large diameter rock drill of claim 8, wherein the arrays of pockets on said expander body comprise continuations of the arrays of pockets on said basic unit body when said expander body is mounted around said basic unit body, each of said pockets disposed on said bodies being located at a unique distance from the longitudinal axis of the drill.

10. The large diameter rock drill of claim 9, wherein each of said linear arrays of pockets of the assembled expander body and basic unit body extends substantially continuously from said inside wall of said expander body to the longitudinal axis of the drill.

11. The large diameter rock drill of claim 7, wherein the radially outermost pocket of each array on said expander body is attached to one of a plurality of vertically extending, radially outwardly projecting ribs mounted on the outside wall of the expander body, in register with the spacer members.

12. The large diameter rock drill of claim 11, wherein said expander body includes a plurality of body teeth mounted on its lower circumferential outer periphery between said ribs mounted on said expander body in register with the spacer members.

13. The large diameter rock drill of claim 12, and including an additional vertically extending, radially outwardly projecting rib mounted on the outside wall of said expander body between said ribs which are in register with said spacer members, and further including a vertically extending support member mounted on the outside wall of said expander body between each pair of adjacent ribs, said body teeth of said expander body being mounted on one of said additional ribs or support members.

14. The large diameter rock drill of claim 7, wherein said attachment means disposed on said spacer members includes a pair of L-shaped flanges mounted along the radially inner edge of each of said spacer members, one leg of each of said flanges being adapted for attachment to the exterior wall surface of said basic unit body, said ribs of said basic unit body being received between the other legs of said flanges when said expander body is mounted on said basic unit body.

15. A large diameter rock drill, comprising;

an annular body having an inside wall, and upper and lower edges;

a central shaft longitudinally axially dispose with respect to said body and having an upper end, said shaft extending longitudinally axially of said above its upper edge, upper end of said shaft being adapt for attachment to a source of rotary power for rotating the drill; and a plurality of radially extending angularly spaced apart plates attached to said inside wall of said body and said shaft, each of said plates having a lower edge which tapers downwardly and inwardly from said inside wall of said body toward the longitudinal axis of the drill near its lower end, each of said lower edges of said plates having a plurality of tooth pockets mounted thereon in a substantially linear array, each of said tooth pockets being adapted for removably receiving a drill tooth therewithin;

said upper end of said shaft extending above said upper edge of said body, and further including a plurality of reinforcing struts mounted between said inside wall of said body and said shaft near said upper end, in angular alignment with one of said plates.

16. A large diameter rock drill, comprising:

an annular body having an inside wall, and upper and lower edges;

a central shaft longitudinally axially disposed with respect to said body and having an upper end, said shaft extending longitudinally axially of said body above its upper edge, said upper end of said shaft being adapted for attachment to a source of rotary power for rotating the drill; and a plurality of radially extending, angularly spaced apart plates attached to said inside wall of said body and said shaft, each of said plates having a lower edge which tapers downwardly and inwardly from said inside wall of said body toward the longitudinal axis of the drill near its lower end, each of said lower edges of said plates having a plurality of tooth pockets mounted thereon in a substantially linear array, each of said tooth pockets being adapted for removably receiving a drill tooth therewithin;

said upper end of said shaft and at least one of said plates extending above said upper edge of said body.

17. The large diameter rock drill of claim 16, wherein said plates have upper edges that are shaped like quarter circles.

* * * * *